United States Patent [19]

Smith

[11] 4,164,856

[45] Aug. 21, 1979

[54] YARN END COLLECTION

[75] Inventor: Arthur R. Smith, Leicester, England

[73] Assignee: Wildt Mellor Bromley Ltd., Leicester, England

[21] Appl. No.: 846,905

[22] Filed: Oct. 31, 1977

[30] Foreign Application Priority Data

Nov. 10, 1976 [GB] United Kingdom ..... 46767/76

[51] Int. Cl.[2] ..... D04B 15/60

[52] U.S. Cl. ..... 66/140 R; 66/168

[58] Field of Search ..... 66/140 R, 140 S, 145 R, 66/145 S, 134, 168

[56] References Cited

U.S. PATENT DOCUMENTS

| | | | |
|---|---|---|---|
| 2,059,076 | 10/1936 | Aaronson | 66/140 R |
| 2,269,757 | 1/1942 | Davis | 66/140 R |
| 2,401,083 | 5/1946 | Koppel | 66/168 X |
| 2,691,285 | 10/1954 | Brown et al. | 66/140 R |
| 2,919,566 | 1/1960 | Felker | 66/140 S |
| 3,055,199 | 9/1962 | Stack | 66/140 S |
| 3,274,803 | 9/1966 | Schmidt | 66/168 |
| 3,545,233 | 12/1970 | Lombardi | 66/168 X |
| 3,572,059 | 3/1971 | Goadby | 66/140 S |

FOREIGN PATENT DOCUMENTS

| | | | |
|---|---|---|---|
| 1061943 | 7/1959 | Fed. Rep. of Germany | 66/168 |
| 1541201 | 8/1968 | France | 66/168 |
| 271703 | 6/1971 | U.S.S.R. | 66/168 |

*Primary Examiner*—Wm. Carter Reynolds

[57] ABSTRACT

A circular knitting machine includes a cylinder with knitting instrumentalities and a cam arrangement for operating the instrumentalities, the cylinder and the cam arrangement being relatively rotatable, a striper associated with the cam arrangement and having a yarn cutting mechanism, an aperture in the cylinder for propelling air outwardly of the cylinder past the instrumentalities to carry yarn ends cut off by the yarn cutting mechanism outwardly of the striper and a means for collecting yarn ends carried outwardly by the air. The machine can be used in combination with a striper which includes a plurality of yarn feeding fingers movable into and out of a feeding attitude, a trapping mechanism for entrapment of ends of yarn not being fed, a cutting mechanism for severing a yarn previously fed to enable it to be trapped and for severing a yarn newly fed to the needles to free it from entrapment, and a guide associated with the trapping and cutting mechanism for confining yarn ends dropping from the mechanisms to enable them to be carried away from the striper by a flow of air.

9 Claims, 5 Drawing Figures

YARN END COLLECTION

BACKGROUND OF THE INVENTION

Field of Invention

The invention relates generally to yarn end collection from knitting machines but is concerned more particularly with circular knitting machines adapted for yarn end collection, yarn feed or yarn change mechanisms adapted for yarn end collection, referred to herein as stripers, and to combinations of such circular knitting machines and stripers. The yarn ends to be collected by means of the invention may be generated incidentally to a change of yarn fed by a striper to a circular knitting machine or be produced as a side-effect of the starting of yarn feeding.

Background of Invention

The U.S. Pat. 2,824,436 (Stack) shows a yarn clamping and severing mechanism in which one particular feeder has associated with it, separate from the cylinder, a pneumatic means for receiving yarn segments. The U.S. Pat. 3,845,233 (Lombardi) discloses the use of slots in cylinders for passing air to improve the operation of the knitting instrumentalities in the cylinder. Lombardi does nowhere suggest that the resultant outward airflow to be used for an ulterior purpose.

It is the object of this invention to collect waste yarn ends without requiring extensive additional mechanism on the cylinder or striper in a simple and reliable manner.

SUMMARY OF THE INVENTION

According to a first aspect of the invention there is provided a circular knitting machine which includes a cylinder with knitting instrumentalities and a cam arrangement for operating the instrumentalities, the cylinder and the cam arrangement being relatively rotatable, a striper associated with the cam arrangement and having a yarn cutting mechanism, an aperture in the cylinder for propelling air outwardly of the cylinder past the instrumentalities to carry yarn ends cut off by the yarn cutting mechanism outwardly of the striper and a means for collecting yarn ends carried outwardly by the air.

Preferably the circular knitting machine has a stationary cylinder and the collecting means is a receptacle arranged radially outward of the aperture, the striper being free to revolve through a gap between the aperture and the receptacle. Advantageously the knitting machine has a plurality of stripers and the aperture and the receptacle act to dispose of the yarn ends cut off by the cutting mechanisms of the plurality of the stripers.

The cylinder is, in use, fitted with knitting instrumentalities such as needles and jacks and the aperture may extend through locations normally occupied by trick walls. The compressed air may be supplied by a pipe from a compressed air pump associated with individual kitting machines or with a compressed air circuit for a plurality of knitting machines.

According to a second aspect of the invention there is provided a striper for a circular knitting machine which includes a plurality of yarn feeding fingers movable into and out of a feeding attitude, a trapping mechanism for entrapment of ends of yarn not being fed, a cutting mechanism for severing a yarn previously fed to enable it to be trapped and for severing a yarn newly fed to the needles to free it from entrapment, and a guide associated with the trapping and cutting mechanism for confining yarn ends dropping from the mechanisms to enable them to be carried away from the striper by a flow of air.

Preferably the cutting and trapping mechanisms provide one pair of trapping faces for all yarns guided through the fingers and one pair of cooperating severing edges for all these yarns. A yarn end may then drop out at each yarn changing operation. Preferably the guide is adapted to confine yarn ends against circumferential movement with respect to the cylinder of the knitting machine by a diffuse flow of air and to hold the yarn ends temporarily if necessary on a bottom surface formed by the guide.

The two aspects of the invention may be used in combination to first cut off the yarn end, receive it subsequently in the guide, and store it temporarily in the guide until the guide reaches the aperture and the associated receptacle for collection of the yarn end. The guide is then adapted by front and rear openings to permit a flow of air to pass through the guide.

The collection means may have, at least in part, perforated walls to allow flow of air whilst retaining the yarn ends.

BRIEF DESCRIPTION OF THE DRAWINGS

The invention is more particularly described with reference to the drawings in which.

DESCRIPTION OF THE PREFERRED EMBODIMENTS

Figure 1:
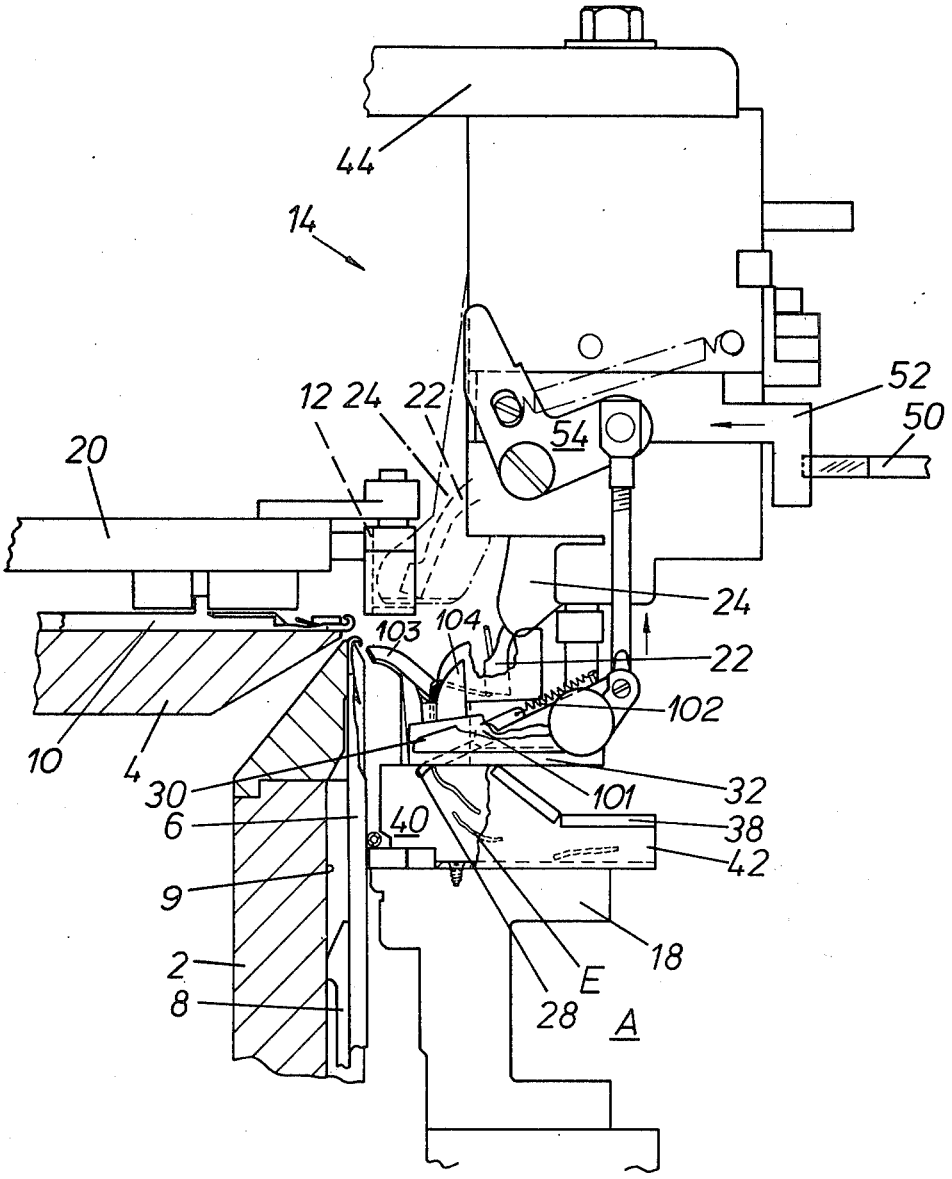
FIG. 1 is a side elevation partly in section, showing a small portion of a cylinder and dial of a knitting machine, together with a striper for supplying different yarns according to the invention.
Figure 2:
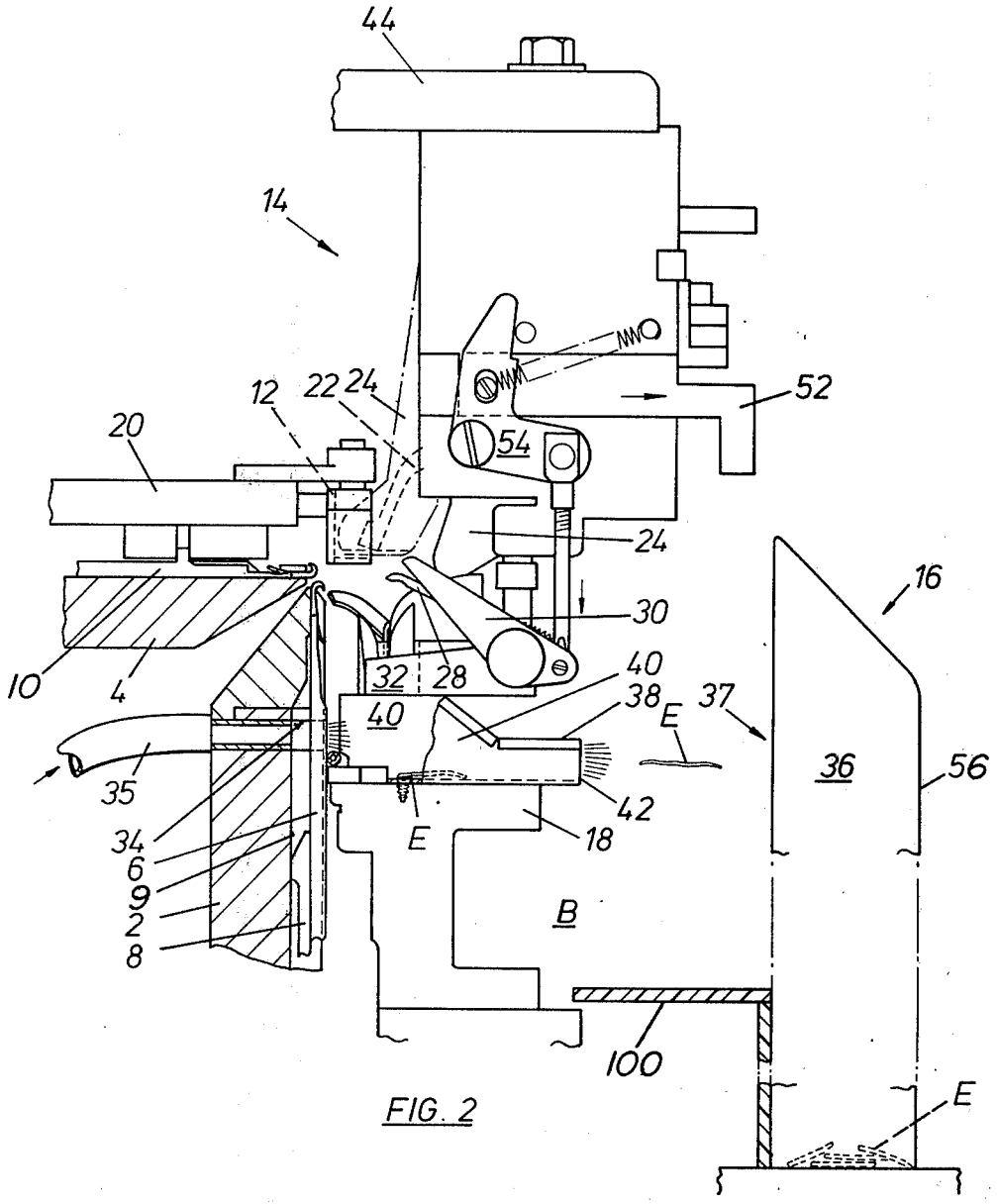
FIG. 2 is a side elevation similar to that of FIG. 1, but showing the striper at a different position along the circumference of the cylinder.
Figure 3:
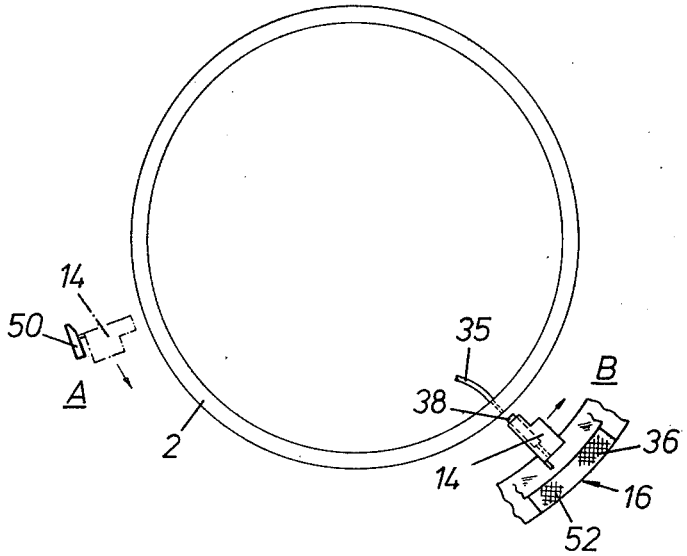
FIG. 3 is a diagrammatic plan view indicating the positions of the striper in FIGS. 1 and 2, position A being that illustrated in FIG. 1 and B being that illustrated in FIG. 2.

With reference to FIGS. 1 to 3, a circular knitting machine has a cylinder 2 and a dial 4 with appropriate instrumentalities such as needles 6 and jacks 8 in tricks 9. Rotatable around the cylinder 2, which is stationary, are a latchguard 12, and a striper 14. Fixed with respect to the cylinder 2 is a yarn end collecting arrangement indicated at 16. The cylinder 2 is surrounded by a rotatable cam system part of which is shown at 18. The dial 4 similarly has a cam system 20.

Figure 5:
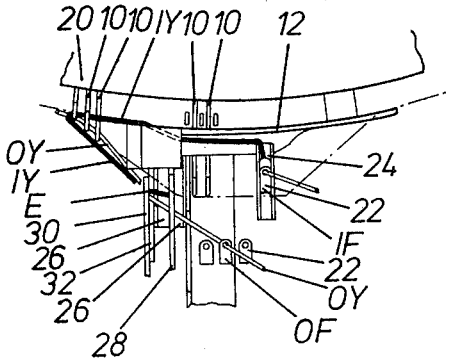
FIG. 5 shows a similar plan view to that in FIG. 4 at the end of a yarn change.
Figure 4:
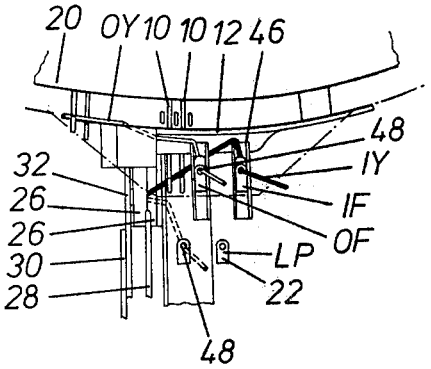
FIG. 4 shows a plan view on an enlarged scale of part of the striper of FIGS. 1 and 2 at the beginning of a yarn change.

With reference also to FIGS. 4 and 5, the striper 14 (of which only one is shown but of which twelve may be provided in a complete machine) has four yarn feeding fingers 22 and associated yarn feeding guides 24. The yarn feeding fingers 22 can be pivoted together with their guides from a low and retracted inactive position shown in solid lines in FIG. 2 to a high and forward position, shown in dotted lines in FIG. 2, adjacent the latchguard 12. The striper has a trapper mechanism with a pair of trapping blocks 26 sprung towards one another and a trapper placer 28 which sweeps between the blocks 26 on downward movement (see FIG.

1) but pivots about pivot 101 extending a return spring 102 to pass clear of the blocks 26 on its upward movement. The trapper placer 28 pivots conjointly with a cutting mechanism including a cutting blade 30 which cooperates with a stationary blade 32 adjacent the trapping blocks 26. Various guide elements 103 and 104 are provided to provide proper alignment of the yarns coming from the fingers 22 for trapping and cutting. Thus, as placer 28 sweeps downwardly between trapper blocks 26, placer 28 pivots rigidly with the blade 30. When placer 28 is pivoted back up with the blade 30, it pivots about pivot 101 so that it is pulled longitudinally upwardly without disturbing the trapped yarn.

At one position (see FIG. 2) the cylinder has a circular aperture 34 extending from the inside of the cylinder 2 right through to the outside of the tricks 9 by removing a short length of the trick walls separating adjacent needles. The aperture 34 is thus such that with the needles 6 in position, slits (not shown) are formed between four adjacent needles 6. The aperture 34 is connected to a compressed air pipe 35 to blow air through the slits in the general direction of the yarn end receiving arrangement or receptacle 16. The arrangement 16 includes a transparent plastics screen 100 extending from the cam system 18 to a receptacle 36. The receptacle 36 may comprise a container with no bottom mounted on a support and having an opening 37 facing the aperture 34.

A striping waste guide 38 is secured by a screw to the cam system 18 under each striper 14 to revolve bodily with each striper. The guide 38 defines a guide passage having a wide opening at the front, with side walls 40 converging to a small opening 42 at the rear and a bottom surface. The guide 38 is open at the top and can receive yarn ends dropping from between the trapping blocks 26 on the bottom surface.

In use, the stripers 14 are rotated by means of cross arms 44 rotatably mounted on a centre shaft (not shown). The cross-arms 44 for the individual stripers 14 rotate together with cam boxes for the cam system 18, which cam boxes are driven by a drive gear meshing with a bottom cam box carriage gear ring (not shown). During normal knitting one yarn feeding finger OF may be in the active, high position with a leading edge 46 of a yarn feeding guide 24 guiding the yarn close to the latchguard 12 and towards the cylinder from a guide aperture 48 in the finger OF. The normal feed path for the yarn OY is shown in FIG. 4. The remaining yarn feeding fingers 22 may be in a low position indicated as LP in FIG. 4 with the yarn extending (as shown in dotted lines in FIG. 4) from between the trapping blocks 26 through guide elements to the guide aperture 48, the leading edge 46 now being behind the fingers 22.

To change the yarns being fed to the needles 10, first a yarn feeding finger 22 is swung to the active high position (see IF in FIG. 4) placing the yarn to be introduced IY close to the latchguard 12. The leading end of the yarn IY swings towards the dial 4 and is placed in the hooks of dial needles 10 which needles are projected radially outward at this stage. Overall the dial needles 10 (only some of which are shown) are projected, to the extent shown in chain dotted lines in FIGS. 4 and 5, by a cam adjacent the striper 14 which revolves bodily with the cam system 18. When, on continued rotation of the striper 14, the dial needles are retracted, the yarn IY becomes secured in the needle hooks (see FIG. 5) whilst the end of the yarn IY is still secured between the blocks 26. The finger OF may be moved to the inactive position (see FIG. 5). So far the cutting and trapping mechanism has been in the attitude shown in FIG. 2.

Next a stationary cam 50 engages a trapper operating slide 52 at position A in FIG. 3 to pivot an operating lever 54 for the trapper placer 28 and the cutting blade 30 against the pull of a return spring. As the placer 28 and blade 30 are pivoted jointly, the position shown in FIG. 1 and FIG. 5 is reached. The yarn OY is placed between the trapping blocks 26 by the placer 28. The blade 30 severs the yarn OY downstream of the trapping block 26 to interrupt the feeding of the yarn OY. As a common cutting and trapping mechanism is used, the blade 30 also severs the yarn IY to cut off a leading end E thereof, whilst the rest of the yarn IY knitted by the needles 10 is now free from the trapping block 26. Thus a short end of yarn E is created which is pushed out by the trapper placer 28 from between the blocks 26 when a subsequent yarn change takes place.

In FIG. 1, the trapper placer 28 is shown removing pieces of cut yarn ends E which have been retained between the blocks 26 as a result of a previous yarn change operation. This takes place at A in FIG. 3.

The ends of yarn E drop into the guide 38. The cut end(s) of yarn is stored in the guide 38 until the striper 14 and the guide 38 reach the position B (see FIG. 3). At this position compressed air is supplied through the pipe 35 to the aperture 34 and the slits between the needles 6. The blast of air at this point passes from the aperture 34, between the side walls 40 through the guide 38 outward of the cylinder 2, thus blowing the yarn end(s) into the opening 37 of the receptacle 36. The air passes only briefly through the guide 38 as the striper 14 continues to revolve. The receptacle 36 is perforated at its outer face 56 to facilitate passage of air through the receptacle 36. Thus the air flow from the aperture 34 carries the ends of yarn from the guide 38 across the gap through which the guide 38 rotates through to the perforated wall. The transparent plastics screen 100 receives any yarn ends which fall short. The yarn ends E accumulate in the lower portion of the receptacle 36. The compressed air may be supplied continuously or intermittently when required by programmed control means. The accumulated ends may be removed by lifting the receptacle 36 and brushing the yarn ends off their support surface.

Using the circular knitting machine, yarn ends are conveniently disposed of, without accumulating on the cam box, pattern drums or other working components of the knitting machine. The yarn ends of a plurality of stripers 14 can be collected at one location.

The machine may be modified to collect the yarn ends for a series of yarn changes in the guide 38 before propelling these ends to the receptacle 36. The machine may have a rotatable cylinder and air may be supplied through a pipe revolving bodily with the cylinder. In this case the striper, waste guide, and cam box will be stationary. Cut yarn ends may be removed from the guide 38 at the knitting station such as indicated at position A in FIGS. 2 and 3 without carrying it along for a short period in the guide 38. The disposal operation may then be performed at several knitting stations around the machine using appropriate cam controls.

I claim:

1. A circular knitting machine including a stationary cylinder, knitting instrumentalities including needles in the cylinder and a cam arrangement for operating the instrumentalities, the cam arrangement being rotatable with respect to the cylinder, at least one striper moveable conjointly with the cam arrangement, said striper having a front and a rear and mounted with its front in proximity to the cylinder, said striper during operation producing yarn ends, a guide passage associated with each striper, said guide passage extending from the front to the rear of each striper and being located to temporarily hold yarn ends dropped from the striper at any stage of the cam arrangement rotation, aperture means in the stationary cylinder for directing air outwardly from the cylinder past the instrumentalities, stationary receptacle means located opposite the aperture means for collecting yarn ends produced by each striper when the guide passage associated with each striper passes between the aperture means and the receptacle means.

2. Circular knitting machine as claimed in claim 1, wherein said stationary receptacle means is arranged radially outward of the aperture means, the striper rotating through a gap between the aperture means and the receptacle means.

3. Circular knitting machine as claimed in claim 1 wherein there is provided a single aperture means and a single receptacle means for disposing of the yarn ends cut off by the cutting mechanisms of each striper.

4. A circular knitting machine as in claim 1 wherein the knitting machine includes a plurality of tricks and the aperture means extends radially through locations in the cylinder midway between the tricks.

5. A circular knitting machine according to claim 1 wherein the striper includes a plurality of yarn feeding fingers moveable into and out of a feeding attitude, a trapping mechanism for entrapment of ends of yarn not being fed, a cutting mechanism for severing a yarn previously fed to enable the yarn to be trapped and for severing a yarn newly fed to the needles to free the yarn from entrapment.

6. A circular knitting machine as in claim 5 wherein the cutting and trapping mechanisms provide one pair of trapping faces for all yarns guided through the fingers and one pair of cooperating severing edges for all yarns guided through the fingers.

7. A striper for use in circular knitting machines of the type having a cylinder carrying needles and having an aperture for directing air outwardly from the cylinder, said striper comprising a front and a rear, the front capable of being mounted in proximity to the cylinder of the circular knitting machine, a plurality of yarn feeding fingers moveable into and out of a feeding attitude, a trapping mechanism for entrapment of ends of yarn not being fed, a cutting mechanism for severing yarn previously fed to enable the yarn to be trapped and for severing yarn newly fed to the needles of the cylinder to free the yarn from entrapment, said striper having a guide passage extending substantially from the front to the rear of the striper, said passage having side and bottom surfaces and open at the top to receive yarn ends dropping from the cutting and trapping mechanisms, said passage open at the front and rear of the striper to permit the removal of yarns from the guide passage by the flow of air from the aperture.

8. A striper according to claim 7 wherein the cutting and trapping mechanisms provide one pair of trapping faces for all yarns guided through the fingers and one pair of cooperating severing edges for all yarns guided through the fingers.

9. Striper as claimed in claim 1 wherein the guide extends substantially radially of the cylinder so as to confine yarn ends against circumferential movement with respect to the cylinder of the knitting machine and the guide includes a lower support surface so as to optionally hold the yarn ends temporarily.

* * * * *